US006070718A

United States Patent [19]

Drabwell

[11] Patent Number: 6,070,718

[45] Date of Patent: Jun. 6, 2000

[54] INSULATED CONTAINER SYSTEM

[76] Inventor: David A. Drabwell, 54 West Park Avenue, Billericay, Essex, United Kingdom, CM12 9EF

[21] Appl. No.: 09/307,354

[22] Filed: May 6, 1999

[51] Int. Cl.[7] ..... B65D 81/18

[52] U.S. Cl. ..... 206/216; 108/26; 206/818; 220/592.2

[58] Field of Search ..... 62/371, 372, 457.7, 62/457.9; 108/14, 25, 26; 126/275 R, 261; 206/216, 541, 542, 545, 546, 549, 818, 457.1; 220/315, 495.03, 495.06, 592, 592.2, 592.03

[56] References Cited

U.S. PATENT DOCUMENTS

| | | | |
|---|---|---|---|
| 1,142,932 | 6/1915 | Clark | 206/541 |
| 2,645,332 | 7/1953 | Martin et al. | 206/545 |
| 2,883,041 | 4/1959 | Pfeifer et al. | 206/541 |
| 3,749,301 | 7/1973 | Peckar | 220/315 |
| 4,648,512 | 3/1987 | Tarozzi et al. | 206/542 |
| 4,899,904 | 2/1990 | Dooley et al. | 206/545 |
| 4,915,219 | 4/1990 | Ottimo | 206/209.1 |
| 5,244,268 | 9/1993 | Derrickson | 206/545 |
| 5,251,542 | 10/1993 | Itoh et al. | 206/545 |
| 5,533,361 | 7/1996 | Halpern | 62/371 |
| 5,658,314 | 8/1997 | Scheffer et al. | 62/457.1 |

*Primary Examiner*—Jim Foster

[57] ABSTRACT

A insulated container system for facilitating storage of items with minimal temperature change over time. The insulated container system includes a container of insulated material having a removable lid stabilized by magnets, a table top stabilized by magnets, and a compartmented removable insulating insert generally conforming to an interior shape of the container. The compartments of the insert are designed for retaining hot or cold packs within the main compartment. Additional side compartments and a storage drawer are provided. The table top is foldable for storage between brackets on the main compartment. It is most preferred that the container include a flared bottom portion for preventing tippage of the container.

20 Claims, 3 Drawing Sheets

INSULATED CONTAINER SYSTEM

BACKGROUND OF THE INVENTION

1. Field of the Invention

The present invention relates to insulated containers and more particularly pertains to a new insulated container system for facilitating storage of items with minimal temperature change over time.

2. Description of the Prior Art

The use of insulated containers is known in the prior art. More specifically, insulated containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,572,054; U.S. Pat. No. 5,524,761; U.S. Pat. No. 3,979,007; U.S. Pat. No. 3,791,547; U.S. Pat. No. 2,663,391; and U.S. Pat. No. Des. 309,239.

While these devices fulfill their respective, particular objectives and requirements, the aforementioned patents do not disclose a new insulated container system. The inventive device includes a container of insulated material having a removable lid and table top stabilized by magnets and a compartmented removable ice bag generally conforming to an interior shape of the container.

In these respects, the insulated container system according to the present invention substantially departs from the conventional concepts and designs of the prior art, and in so doing provides an apparatus primarily developed for the purpose of facilitating storage of items with minimal temperature change over time.

SUMMARY OF THE INVENTION

In view of the foregoing disadvantages inherent in the known types of insulated containers now present in the prior art, the present invention provides a new insulated container system construction wherein the same can be utilized for facilitating storage of items with minimal temperature change over time.

The general purpose of the present invention, which will be described subsequently in greater detail, is to provide a new insulated container system apparatus and method which has many of the advantages of the insulated containers mentioned heretofore and many novel features that result in a new insulated container system which is not anticipated, rendered obvious, suggested, or even implied by any of the prior art insulated containers, either alone or in any combination thereof.

To attain this, the present invention generally comprises a container of insulated material having a removable lid and table top stabilized by magnets and a compartmented removable ice bag generally conforming to an interior shape of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulated container system apparatus and method which has many of the advantages of the insulated containers mentioned heretofore and many novel features that result in a new insulated container system which is not anticipated, rendered obvious, suggested, or even implied by any of the prior art insulated containers, either alone or in any combination thereof.

It is another object of the present invention to provide a new insulated container system that may be easily and efficiently manufactured and marketed.

It is a further object of the present invention to provide a new insulated container system that is of a durable and reliable construction.

An even further object of the present invention is to provide a new insulated container system which is susceptible of a low cost of manufacture with regard to both materials and labor, and which accordingly is then susceptible of low prices of sale to the consuming public, thereby making such insulated container system economically available to the buying public.

Still yet another object of the present invention is to provide a new insulated container system which provides in the apparatuses and methods of the prior art some of the advantages thereof, while simultaneously overcoming some of the disadvantages normally associated therewith.

Still another object of the present invention is to provide a new insulated container system for facilitating storage of items with minimal temperature change over time.

Yet another object of the present invention is to provide a new insulated container system which includes a container of insulated material having a removable lid and table top stabilized by magnets and a compartmented removable ice bag generally conforming to an interior shape of the container.

Still yet another object of the present invention is to provide a new insulated container system that is self-contained, portable and compact.

Even still another object of the present invention is to provide a new insulated container system that provides an insulated container having multiple storage compartments.

Yet another object of the present invention is to provide a new insulated container system that is convertible into a table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
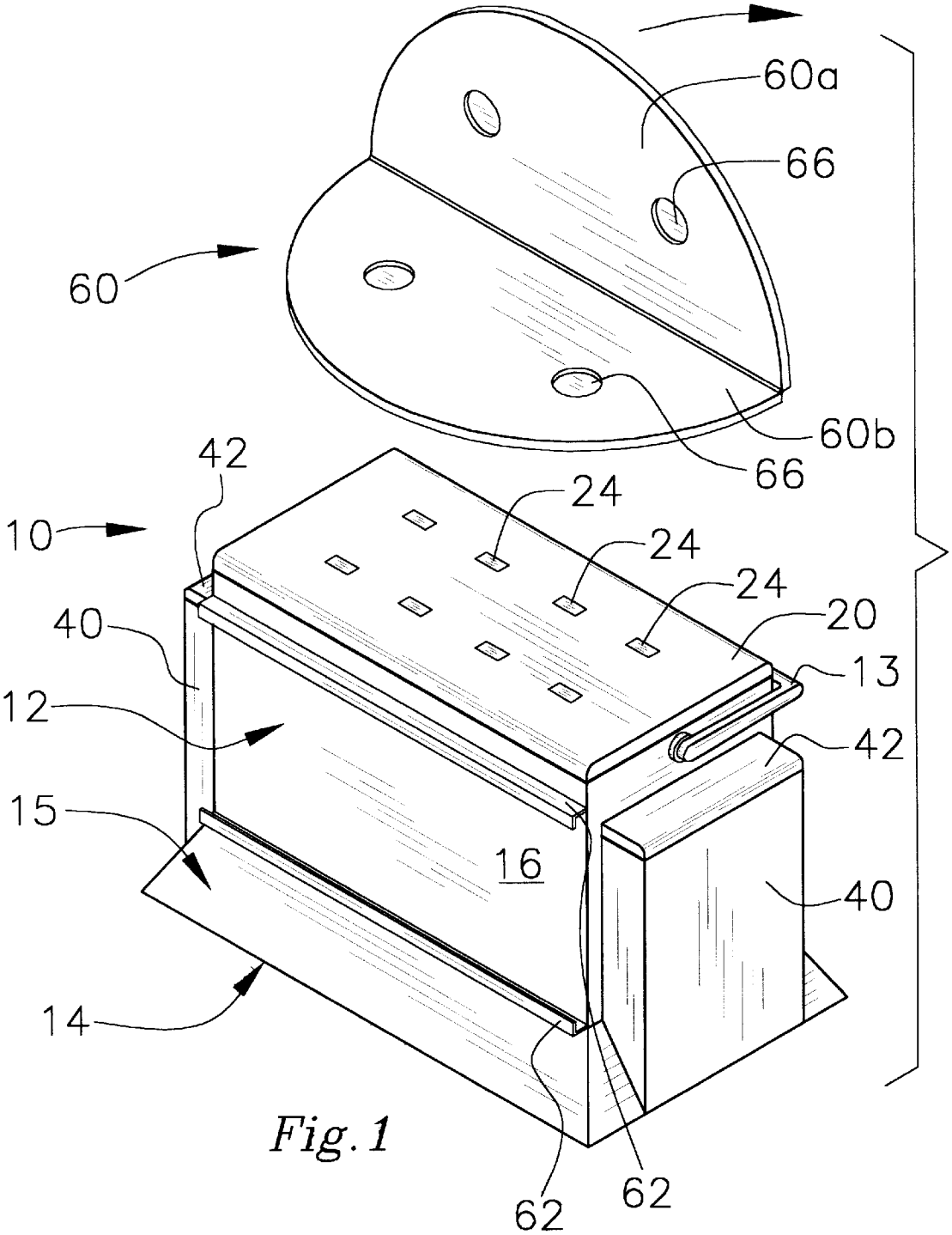
FIG. 1 is a perspective view of a new insulated container system according to the present invention.
Figure 2:
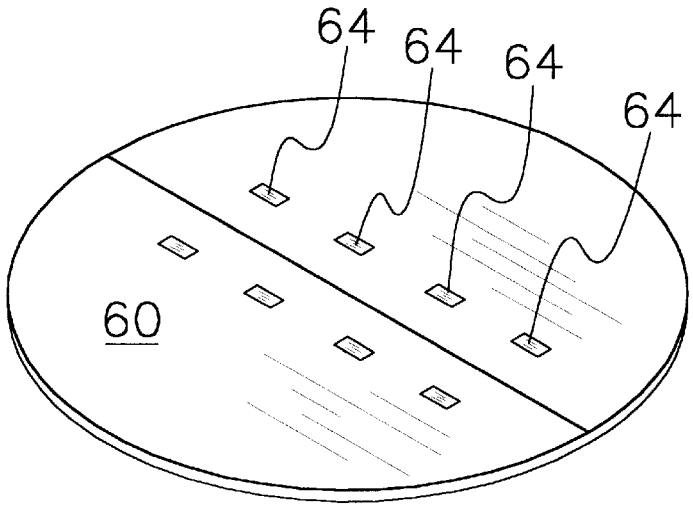
FIG. 2 is a perspective view of the underside of the table top of the present invention.
Figure 3:
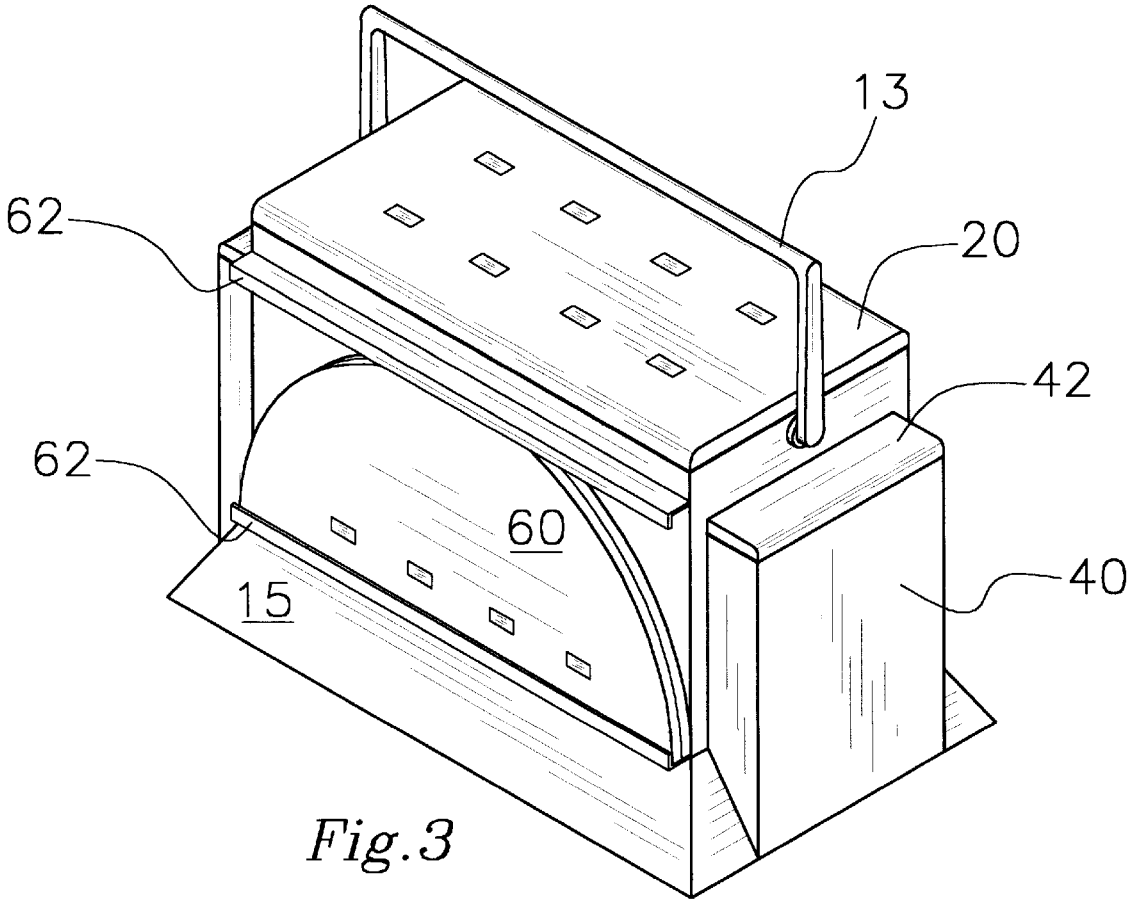
FIG. 3 is a perspective view of the present invention.
Figure 4:
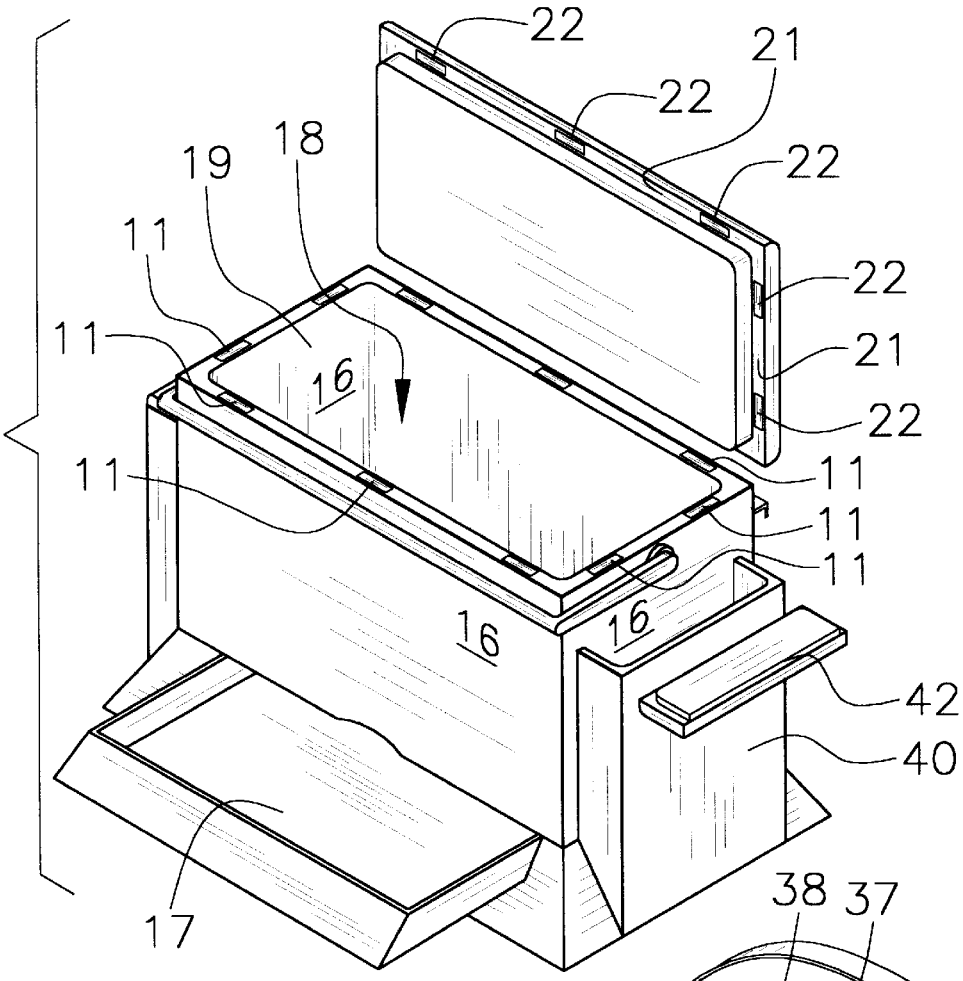
FIG. 4 is a perspective view of the opposite side of the present invention.
Figure 5:
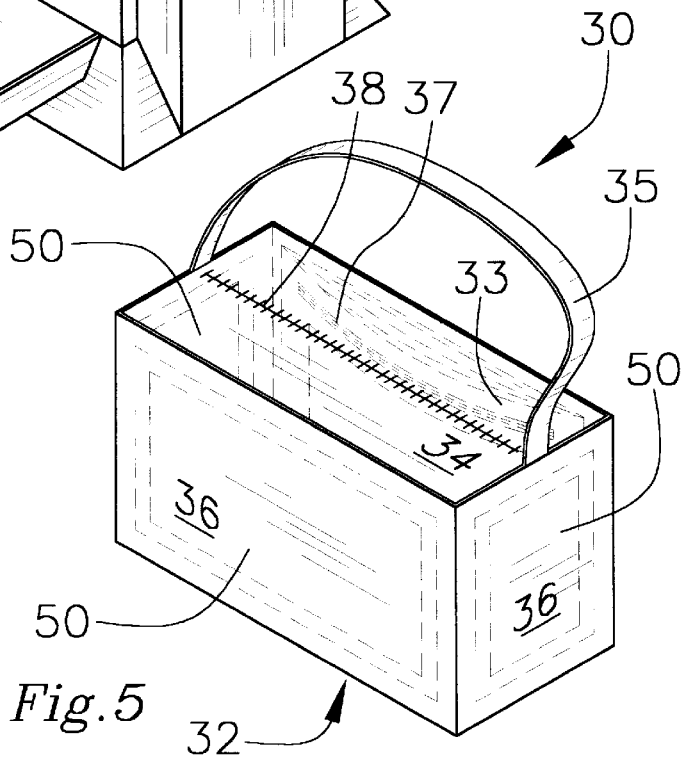
FIG. 5 is a perspective view of the insulating insert of the present invention.

With reference now to the drawings, and in particular to FIGS. 1 through 5 thereof, a new insulated container system embodying the principles and concepts of the present invention and generally designated by the reference numeral 10 will be described.

As best illustrated in FIGS. 1 through 5, the insulated container system 10 generally comprises a main compartment 12 having a bottom 14 and a plurality of walls 16 extending upwardly from the bottom 14 to define an interior space 18, a pivoting handle 13, and a top opening 19. The pivoting handle 13 is preferably coupled to opposing walls 16 of the main compartment 12 such that the handle is parallel to a longitudinal axis of the main compartment 12. Preferably, the bottom 14 and the walls 16 of the main compartment 12 are constructed of an insulating material. For added convenience, a pair of side compartments 40 extend outwardly from opposite side walls 16 of the main compartment 12. Each side compartment 40 has a respective side lid 42 for snugly engaging the side compartment 40.

Additionally, the main compartment includes a bottom portion 15 that is flared outwardly for preventing tippage of the main compartment 12. For increased storage space for items not requiring heavy insulation, a drawer 17 is positioned in the bottom portion 15 of the main compartment 12.

The insulated container system 10 includes a lid 20 for snugly engaging the top opening 19 of the main compartment 12. Preferably, a plurality of magnets 11 are positioned around a perimeter of the top opening 19 and a plurality of magnets 22 are positioned around a lip 21 of the lid 20. The lid magnets 22 are positioned to engage the compartment magnets 11 when the lid 20 is positioned over the opening 19 such that the lid 20 is detachably coupled to the main compartment 12.

The insulated container system 10 also includes an insulating insert 30 having a bottom 32, a top 34, and side walls 36 extending between the top 32 and the bottom 34. The insulating insert 30 is proportioned to fit snugly within the interior space 18 of the main compartment 12. An insert handle 35 is coupled to the insulating insert 30 for facilitating removal and insertion of the insulating insert 30 from and into the interior space 18 of the main compartment 12.

The top of the insulating insert 30 has an opening 38, preferably zippered. The opening 38 of the insulating insert 30 is designed for permitting insertion of items into the insulating insert 30. Thus the items being stored are held within the insert 30 which is in turn held within the main compartment 12 to provide maximum insulation and superior storage of the items.

Each of the side walls 36 of the insulating insert 30 has a pocket 33 designed for receiving a thermal alteration means 50 for altering an interior temperature of the interior space 18 of the main compartment 12 when the means 50 has an internal temperature that varies from the interior temperature of the interior space 18 of the main compartment 12. The thermal alteration means 50 can be either a heat pack or an ice pack depending on whether items within the insulating insert are to be kept cold or hot.

Each of the pockets 33 includes a zipper seal 37 for sealing the respective thermal alteration means 50 held within each pocket 33.

A table top 60 is formed by two substantially equal halves 60A and 60B hinged together such that the halves 60A and 60B are foldable together for storage of the table top 60. A plurality of cup holders 66 are positioned in the table top 60 for receiving cups in a stable position to prevent accidental spillage. A pair of spaced brackets 62 are coupled to an outer surface of the main compartment 12 such that the table top 60 can be folded and stored between the brackets 62. The table top 60 preferably includes a plurality of lid engaging magnets 64 on an underside of the table top 60. The lid 20 would most preferably include a matching plurality of table engaging magnets 24 on an upper surface of the lid 20. The magnets 24 are oriented and positioned such that the magnets 64 and 24 attract each other such that the table top 60 is engageable to the lid 20 by joining magnets 64 and magnets 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulated container system comprising:

a main compartment having a bottom and a plurality of walls extending upwardly from the bottom to define an interior space and a top opening;

a lid for covering said top opening of said main compartment;

an insulating insert having a bottom, a top, and side walls extending between the top and the bottom, said insulating insert being proportioned to fit within said interior space of said main compartment;

said top of said insulating insert having an opening therein, said opening of said insulating insert being for permitting insertion of items into said insulating insert; and each of said side walls of said insulating insert having a pocket formed therein, said pocket being for receiving a thermal alteration means for altering an interior temperature of the interior space of the main compartment when said means has an internal temperature that varies from the interior temperature of the interior space of the main compartment.

2. The insulated container system of claim 1 further comprising:

a pair of side compartments, each of said side compartments extending outwardly from an exterior of a respective one of said side walls of said main compartment.

3. The insulated container system of claim 1 further comprising:

a plurality of magnets positioned around a perimeter of said top opening; and a plurality of magnets positioned around a lip of said lid, said lid magnets being positioned to engage said compartment magnets when said lid is positioned over said opening whereby said lid is detachably coupled to said main compartment.

4. The insulated container system of claim 1 wherein said bottom and said walls of said main compartment are constructed of an insulating material.

5. The insulated container system of claim 1, wherein the thermal alteration means is chosen from the group of thermal alteration means consisting of a heat pack and an ice pack.

6. The insulated container system of claim 1, wherein each of said pockets includes a zipper seal for sealing a respective said thermal alteration means within each pocket.

7. The insulated container system of claim 1, further comprising:

said main compartment having a bottom portion, said bottom portion being flared outwardly for preventing tippage of said main compartment.

8. The insulated container system of claim 1, further comprising:

a pivoting handle coupled to opposing walls of the main compartment.

9. The insulated container system of claim 1, further comprising:

an insert handle coupled to said insulating insert for facilitating removal and insertion of the insulating insert from and into the interior space of the main compartment.

10. The insulated container system of claim 2, further comprising:

each side compartment having a respective side lid for snugly engaging said side compartment.

11. An insulated container system comprising:

a main compartment having a bottom and a plurality of walls extending upwardly from the bottom to define an interior space and a top opening;

a lid for covering said top opening of said main compartment;

an insulating insert having a bottom, a top, and side walls extending between the top and the bottom, said insulating insert being proportioned to fit within said interior space of said main compartment;

said top of said insulating insert having an opening therein, said opening of said insulating insert being for permitting insertion of items into said insulating insert;

a plurality of magnets positioned around a perimeter of said top opening;

a plurality of magnets positioned around a lip of said lid, said lid magnets being positioned to engage said compartment magnets when said lid is positioned over said opening whereby said lid is detachably coupled to said main compartment;

a table top being formed by two substantially equal halves hinged together such that said halves are foldable together for storage of the table top; and a pair of spaced brackets coupled to an outer surface of said main compartment, said brackets being positioned to receive said table top therebetween when said halves are folded whereby said table top is coupled to said main compartment for storage.

12. The insulated container system of claim 11 further comprising;

said lid including a plurality of table engaging magnets on an upper surface thereof;

said table top having a plurality of lid engaging magnets on an underside thereof, said table engaging magnets and said lid engaging magnets being oriented to attract each other and aligned with respect to each other such that said table top is engageable to said lid.

13. The insulated container system of claim 11, further comprising:

a plurality of cup holders positioned in said table top.

14. The insulated container system of claim 11, further comprising:

a pair of side compartments, each of said side compartments extending outwardly from an exterior of a respective one of said side walls of said main compartment.

15. The insulated container system of claim 11 wherein said bottom and said walls of said main compartment are constructed of an insulating material.

16. The insulated container system of claim 11, further comprising:

said main compartment having a bottom portion, said bottom portion being flared outwardly for preventing tippage of said main compartment.

17. The insulated container system of claim 11, further comprising:

a pivoting handle coupled to opposing walls of the main compartment.

18. The insulated container system of claim 11, further comprising:

an insert handle coupled to said insulating insert for facilitating removal and insertion of the insulating insert from and into the interior space of the main compartment.

19. An insulated container system comprising:

a main compartment having a bottom and a plurality of walls extending upwardly from the bottom to define an interior space and a top opening;

a lid for covering said top opening of said main compartment;

an insulating insert having a bottom, a top, and side walls extending between the top and the bottom, said insulating insert being proportioned to fit within said interior space of said main compartment;

said top of said insulating insert having an opening therein, said opening of said insulating insert being for permitting insertion of items into said insulating insert;

said main compartment having a bottom portion, said bottom portion being flared outwardly for preventing tippage of said main compartment; and a drawer in said bottom portion of said main compartment.

20. An insulated container system comprising:

a main compartment having a bottom and a plurality of walls extending upwardly from the bottom to define an interior space and a top opening;

a lid for snugly engaging said top opening of said main compartment;

an insulating insert having a bottom, a top, and side walls extending between the top and the bottom, said insulating insert being proportioned to fit within said interior space of said main compartment;

said top of said insulating insert having an opening therein, said opening of said insulating insert being for permitting insertion of items into said insulating insert;

a pair of side compartments, each of said side compartments extending outwardly from an exterior of a respective one of said side walls of said main compartment;

a plurality of magnets positioned around a perimeter of said top opening;

a plurality of magnets positioned around a lip of said lid, said lid magnets being positioned to engage said compartment magnets when said lid is positioned over said opening whereby said lid is detachably coupled to said main compartment;

wherein said bottom and said walls of said main compartment are constructed of an insulating material;

each of said side walls of said insulating insert having a pocket formed therein, said pocket being for receiving a thermal alteration means for altering an interior temperature of the interior space of the main compartment when said means has an internal temperature that varies from the interior temperature of the interior space of the main compartment;

wherein the thermal alteration means is chosen from the group of thermal alteration means consisting of a heat pack and an ice pack;

wherein each of said pockets includes a zipper seal for sealing a respective said thermal alteration means within each pocket;

a table top being formed by two substantially equal halves hinged together such that said halves are foldable together for storage of the table top;

a pair of spaced brackets coupled to an outer surface of said main compartment, said brackets being positioned to receive said table top therebetween when said halves are folded whereby said table top is coupled to said main compartment for storage;

said lid including a plurality of table engaging magnets on an upper surface thereof;

said table top having a plurality of lid engaging magnets on an underside thereof, said table engaging magnets and said lid engaging magnets being oriented to attract each other and aligned with respect to each other such that said table top is engageable to said lid;

said main compartment having a bottom portion, said bottom portion being flared outwardly for preventing tippage of said main compartment;

a drawer in said bottom portion of said main compartment;

a pivoting handle coupled to opposing walls of the main compartment;

an insert handle coupled to said insulating insert for facilitating removal and insertion of the insulating insert from and into the interior space of the main compartment;

a plurality of cup holders positioned in said table top; and each side compartment having a respective side lid for snugly engaging said side compartment.

* * * * *